US006309469B2

(12) United States Patent
Storrs et al.

(10) Patent No.: US 6,309,469 B2
(45) **Date of Patent: *Oct. 30, 2001**

(54) DEBRIS ACCESS DOOR

(75) Inventors: Charles M. Storrs, Leesburg, FL (US); Robert C. Berfield, Jersey Shore, PA (US)

(73) Assignee: Shop Vac Corporation, Williamsport, PA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/268,908

(22) Filed: Mar. 15, 1999

(51) Int. Cl.[7] ..... A47L 5/36

(52) U.S. Cl. ..... 134/21; 15/310; 15/327.2; 15/331; 15/339

(58) Field of Search ..... 15/331, 337, 339, 15/327.1, 327.2, 310, 353; 134/21

(56) References Cited

U.S. PATENT DOCUMENTS

| | | | | |
|---|---|---|---|---|
| 918,896 | | 4/1909 | Noe . | |
| 1,104,882 | | 7/1914 | Ferguson . | |
| 1,759,242 | | 5/1930 | Nielsen . | |
| 2,247,549 | | 7/1941 | Frederick . | |
| 2,539,257 | * | 1/1951 | Limberg | 15/327.2 X |
| 2,635,277 | | 4/1953 | Belknap . | |
| 2,657,416 | * | 11/1953 | Smith | 15/331 |
| 2,659,925 | | 11/1953 | Wood . | |
| 2,824,335 | | 2/1958 | Moffat . | |
| 3,030,650 | * | 4/1962 | Kiraly | 15/310 |
| 3,089,178 | | 5/1963 | Sherman, Jr. . | |
| 4,019,218 | * | 4/1977 | Cyphert | 15/339 X |
| 4,163,650 | * | 8/1979 | Watson et al. | 15/339 X |
| 4,310,945 | * | 1/1982 | Tribolet | 15/327.2 X |
| 4,342,131 | * | 8/1982 | Reid | 15/327.6 |
| 4,355,434 | * | 10/1982 | Gongwer | 15/327.1 |
| 4,360,947 | * | 11/1982 | DeCosa et al. | 15/339 X |
| 4,497,308 | | 2/1985 | Johnson . | |
| 4,563,790 | | 1/1986 | Clark . | |
| 4,811,450 | | 3/1989 | Steadings . | |
| 4,953,255 | | 9/1990 | Jenkins . | |
| 5,455,983 | * | 10/1995 | Crouser et al. | 15/331 |
| 5,560,075 | * | 10/1996 | Jankowski | 15/327.2 X |
| 5,819,368 | | 10/1998 | Wang et al. . | |

FOREIGN PATENT DOCUMENTS

| | | |
|---|---|---|
| 196 07 959 | 4/1997 | (DE) . |
| 0 643 905 | 3/1995 | (EP) . |

OTHER PUBLICATIONS

International Search Report, International Application No. PCT/US99/16071, International Filing Date Jul. 16, 1999.

* cited by examiner

*Primary Examiner*—Chris K. Moore
(74) *Attorney, Agent, or Firm*—Marshall, Gerstein, & Borun

(57) ABSTRACT

A vacuum cleaner includes a receptacle, a motor assembly in air flow communication with the receptacle, and a lid on the receptacle. The vacuum cleaner also includes a hose inlet on the receptacle, a debris opening, and a door opening and closing the debris opening. The debris opening may be on the receptacle or in the lid of the vacuum cleaner. Alternatively, the vacuum cleaner may include an adaptor that is attached to the hose at one end and removably connected to the hose inlet at the other end, where the debris opening is on the adaptor. The vacuum cleaner may have an adaptor that is removably connected to the hose at one end and removably connected to the hose at the other end, where the debris opening is on the adaptor.

9 Claims, 16 Drawing Sheets

DEBRIS ACCESS DOOR

FIELD OF THE INVENTION

This invention relates generally to vacuum cleaners, and more particularly to devices that allow large debris to enter a vacuum cleaner.

BACKGROUND OF THE INVENTION

Vacuum cleaners generally include a motor assembly, a tank or other receptacle, a hose inlet on the receptacle, and a hose that attaches to the hose inlet at one end and has a nozzle at the other end. The motor of the motor assembly drives an impeller that creates a low pressure area inside the receptacle. The pressure difference between the inside and the outside of the receptacle creates a suction effect at the hose inlet, which causes dust, debris, and liquids to enter the receptacle through the hose.

The capability of vacuum cleaners to pick up large debris has been limited to debris that is smaller than the diameter of the hose. Further, even debris that is smaller than the hose diameter may clog the hose when passing through a bend in the hose. A large diameter hose for accepting large debris may not be acceptable because it will reduce the air velocity in the hose inlet, thus reducing the efficiency of the vacuum cleaner. Hoses are often used with nozzles which may have an even smaller cross section, and further increase the likelihood of clogging. Additionally, a hose with limited bending capability to allow passage of large debris reduces the versatility of the vacuum cleaner by making it ineffective for accessing hard to reach areas. Therefore, in most instances, a vacuum cleaner operator must manually pick up large debris and dispose of it by other means.

SUMMARY OF THE INVENTION

The debris access door eliminates the drawbacks noted above in a simple and effective manner.

Particularly, in accordance with one aspect of the present invention, a vacuum cleaner may include a receptacle and a debris opening in air communication with the receptacle. The vacuum cleaner further includes a lid that is removably attached to the receptacle. Additionally, the vacuum cleaner includes a motor assembly in air communication with the receptacle, a door opening and closing the debris opening, and a hose inlet on the receptacle.

In accordance with another aspect of the present invention, the debris opening may be on the receptacle.

In accordance with another aspect the present invention, the debris opening may be in the lid.

In accordance with another aspect of the present invention, the vacuum cleaner may include an adaptor that is removably connected to the hose inlet at one end and attached to the hose at the other end, where the debris opening is on the adaptor.

In accordance with another aspect of the present invention, the vacuum cleaner may include an adaptor that is removably connected to the hose inlet at one end and removably connected to the hose at the other end, where the debris opening is on the adaptor.

Other features and advantages of the present invention will become apparent from the specification and drawings, in which like reference numerals denote like structures.

DESCRIPTION OF THE PREFERRED EMBODIMENTS

Figure 1:
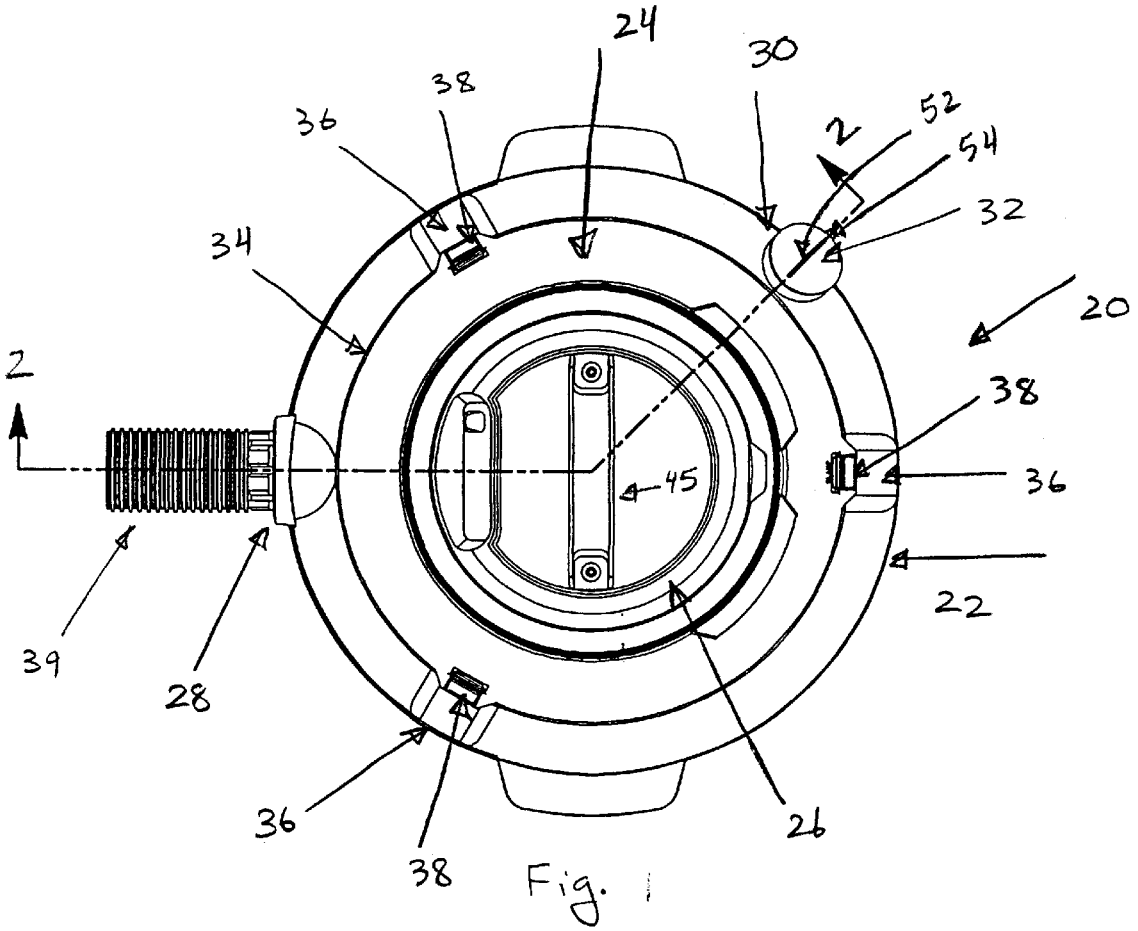
FIG. 1 is a top elevational view of a first embodiment of a vacuum cleaner of the present invention having a debris opening on a receptacle with a door on the debris opening in a closed position.

Referring initially to FIGS. 1–4, a vacuum cleaner 20 includes a receptacle 22, a lid 24, a motor assembly 26, a hose inlet 28, a debris opening 30, and a door 32 opening and closing the debris opening. The lid 24 has a rim 34 which is designed to fit over the edge of the receptacle 22 for the vacuum cleaner 20. Around the periphery of the lid 24 are several latch ports 36 (shown in FIGS. 1 and 3) which cooperate with latches 38 (shown in FIGS. 1 and 3) on the receptacle 22 in order to hold the lid 24 on the receptacle. The lid 24 houses a motor assembly 26 that is in air flow communication with the receptacle 22 through a filter 27 (shown in FIGS. 2 and 4). Generally, the motor assembly 26 includes an electric motor, a power cord 29 (shown in FIGS. 2 and 4) for use with an electrical outlet, an air impeller, and other associated equipment (not depicted) that create a low pressure area inside the receptacle 22. A hose 39 removably connects at a first end 40 to a hose inlet 28 on the receptacle 22. A nozzle 42 (shown in FIGS. 2 and 4) is attached at a second end 44 (shown in FIGS. 2 and 4) of the hose 39 for collecting debris. The vacuum cleaner 20 can be lifted and moved with a handle 45 that is placed on the vacuum cleaner 20. Additionally, the vacuum cleaner 20 can be moved with casters 46 (shown in FIGS. 2 and 4).

Figure 2:
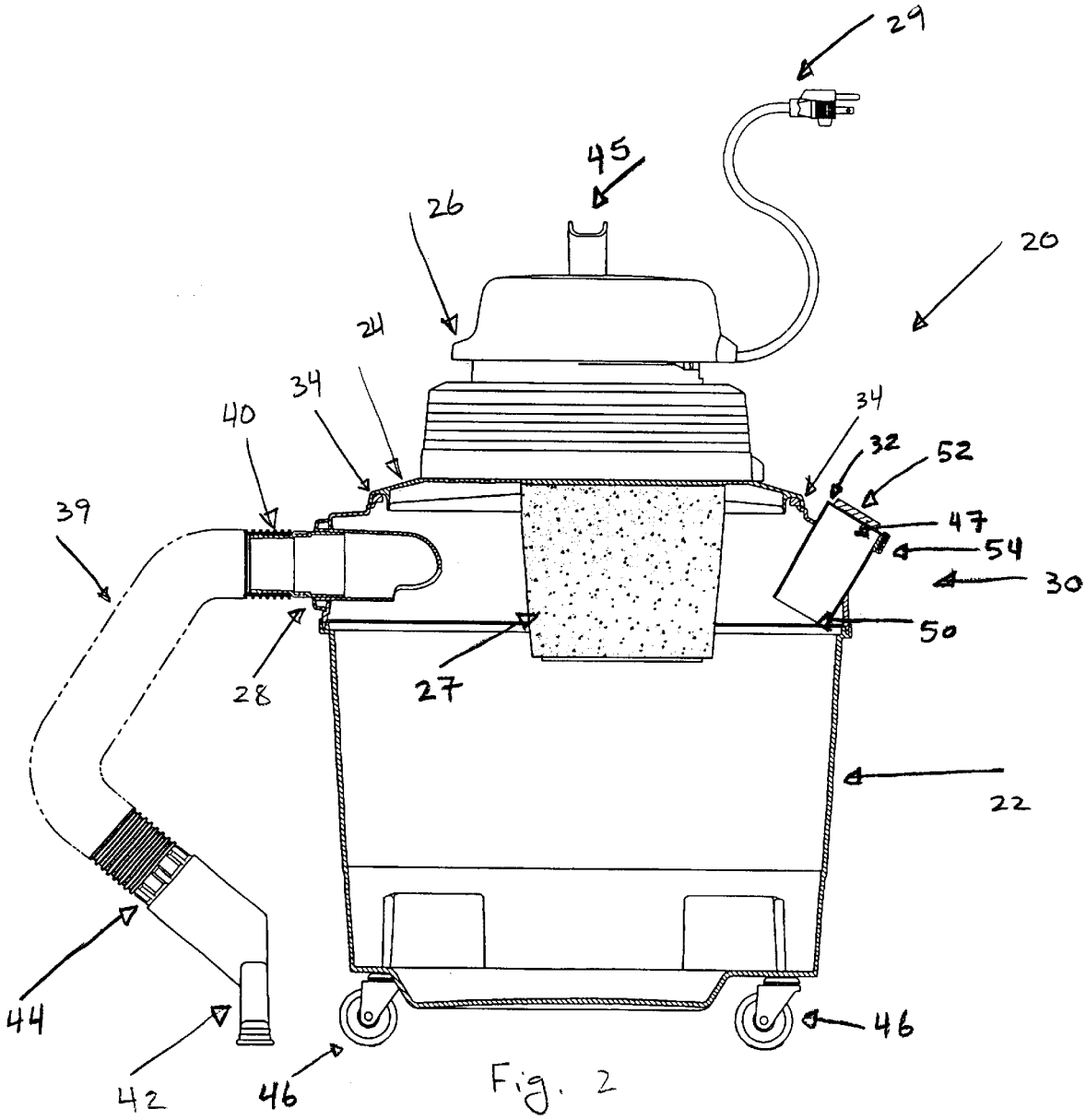
FIG. 2 is a partial cross-sectional view of the vacuum cleaner of FIG. 1 taken at the lines 2—2 of FIG. 1.
Figure 3:
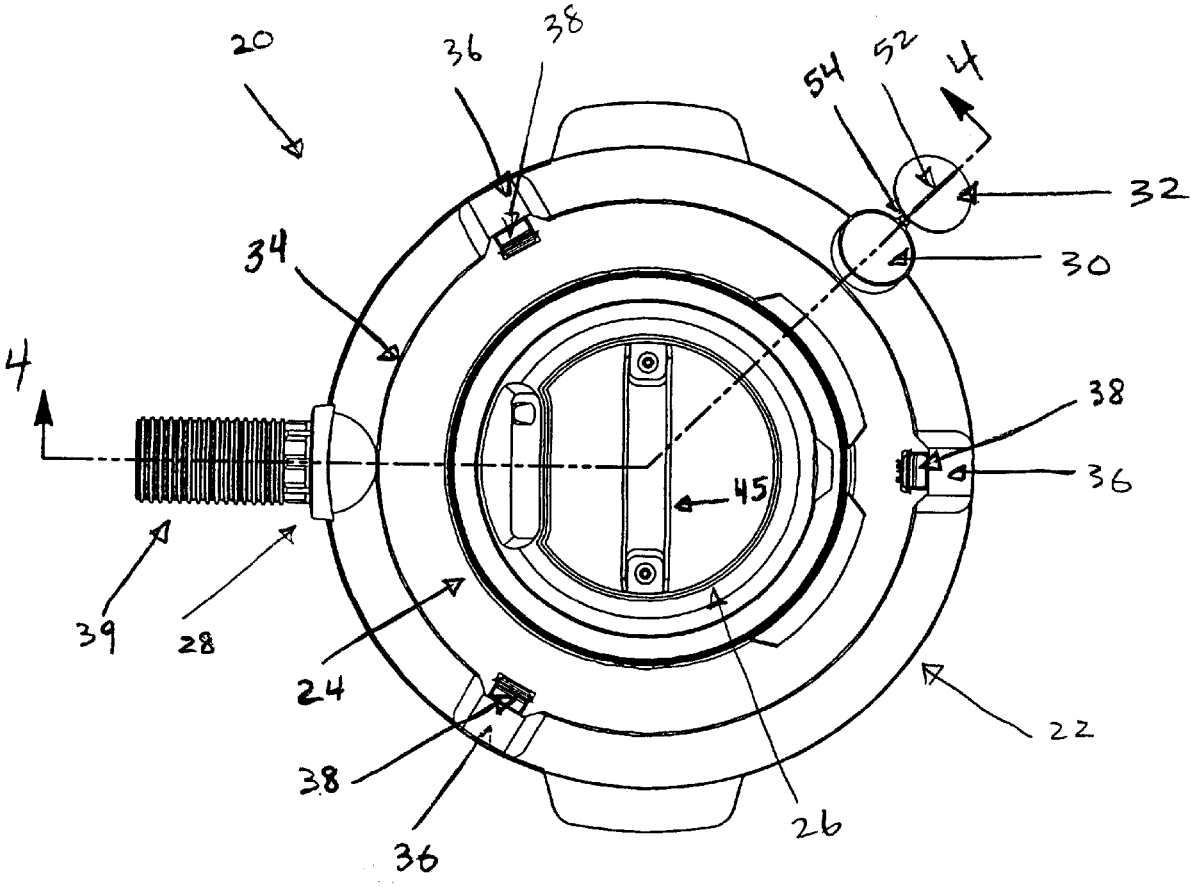
FIG. 3 is a top elevational view of the vacuum cleaner of FIG. 1 having the debris opening in an open position.
Figure 4:
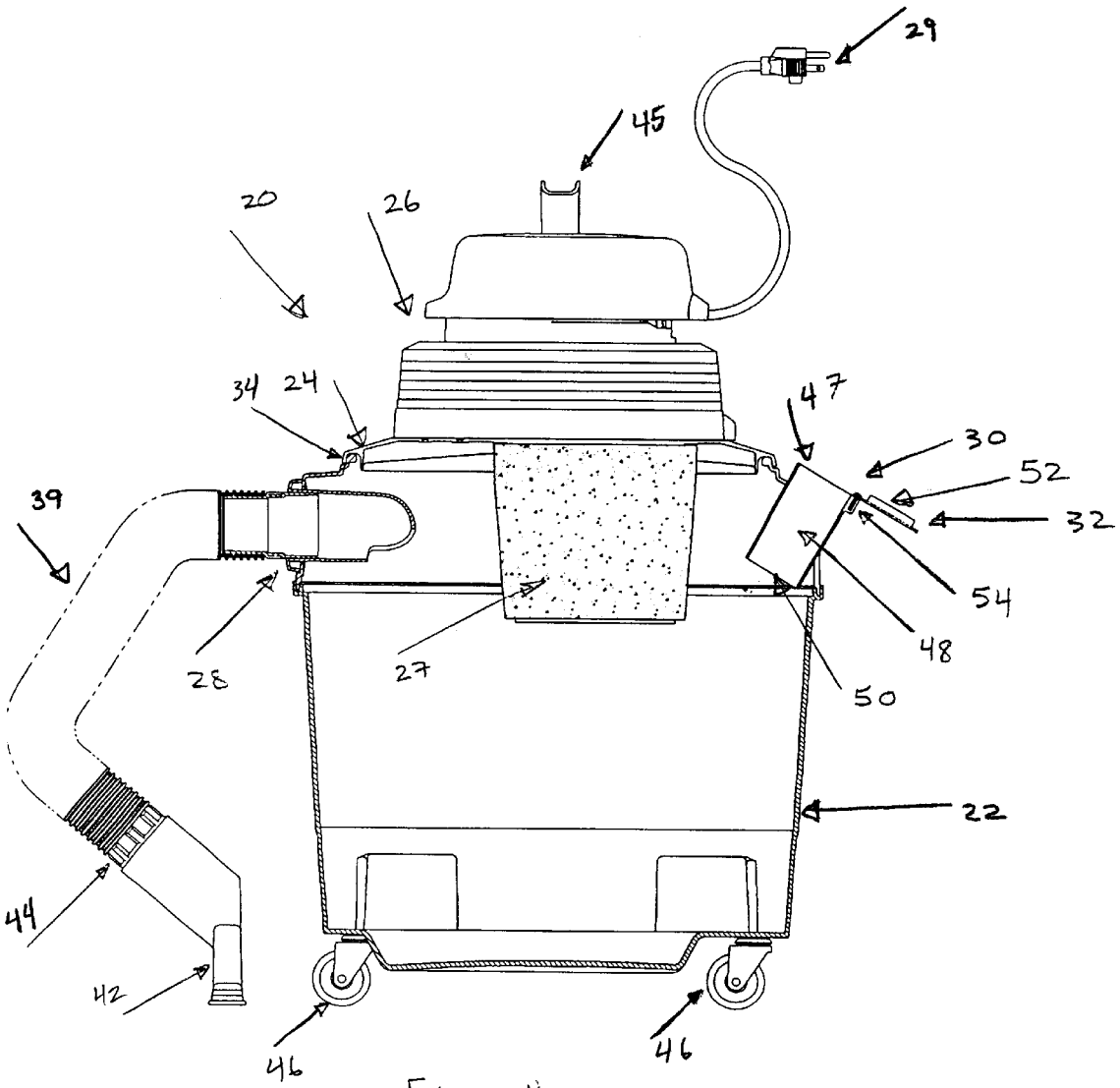
FIG. 4 is a partial cross-sectional view of the vacuum cleaner of FIG. 3 taken at the lines 4—4 of FIG. 3.
Figure 5:
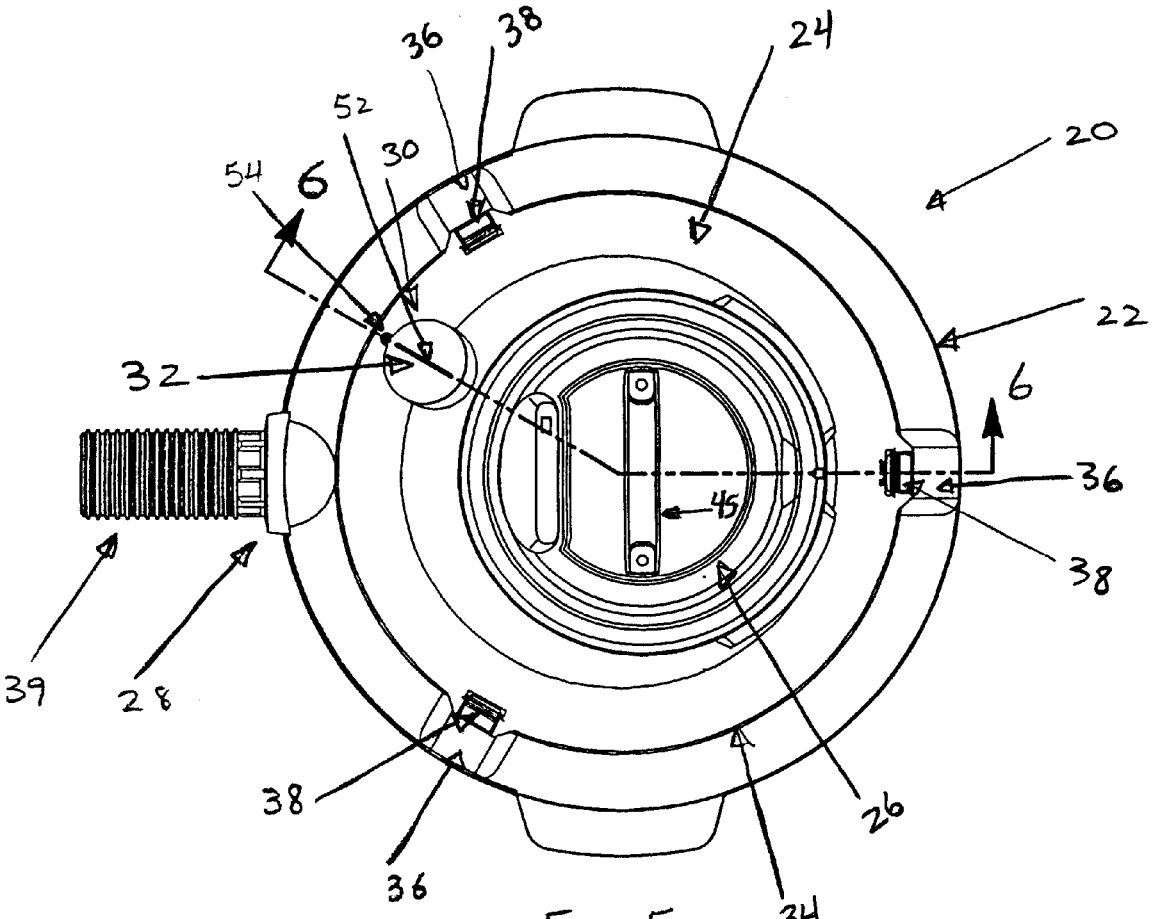
FIG. 5 is a top elevational view of a second embodiment of a vacuum cleaner of the present invention having a debris opening in a lid with a door on the debris opening in a closed position.
Figure 6:
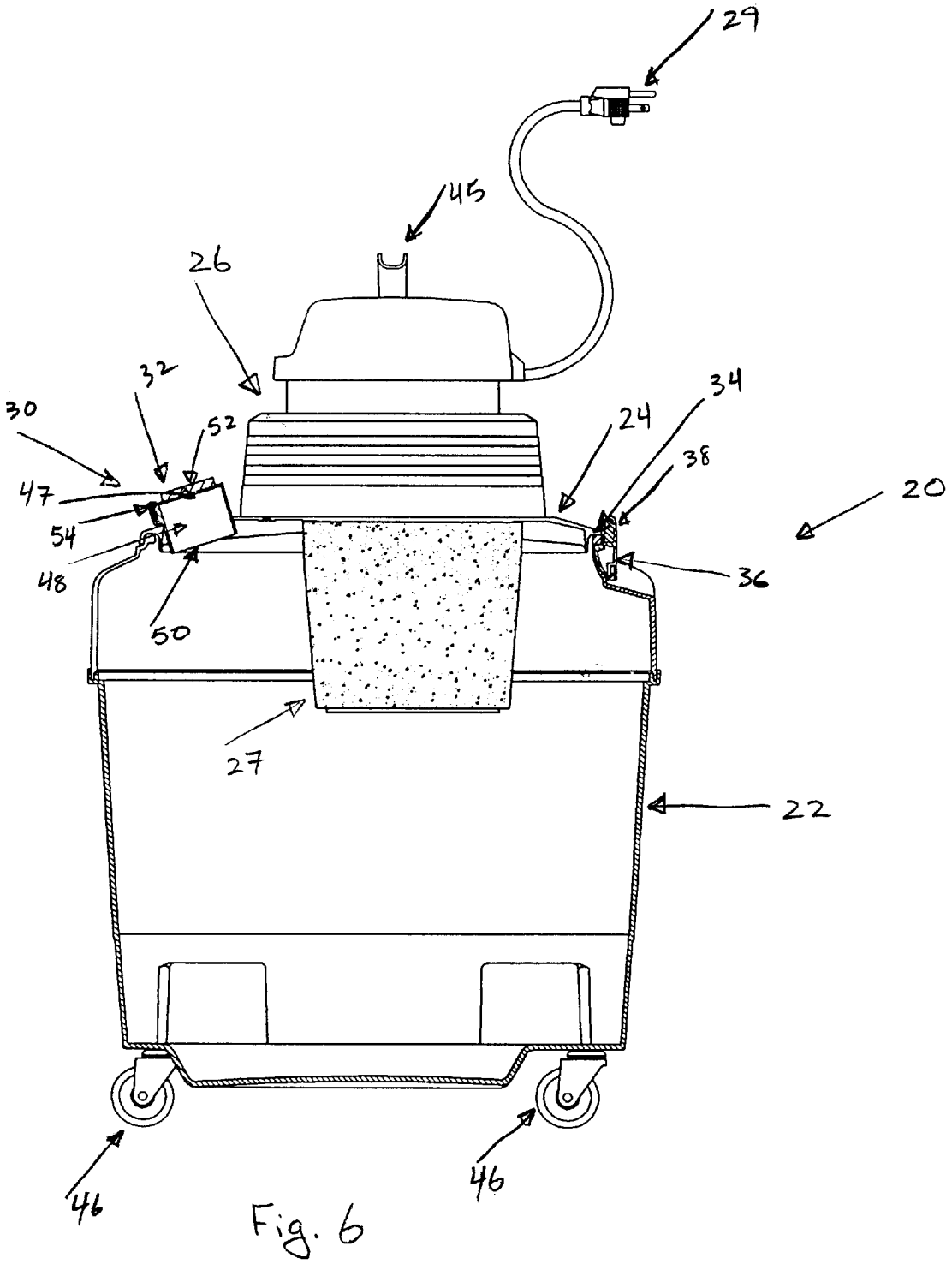
FIG. 6 is a partial cross-sectional view of the vacuum cleaner of FIG. 5 taken at the lines 6—6 of FIG. 5.
Figure 7:
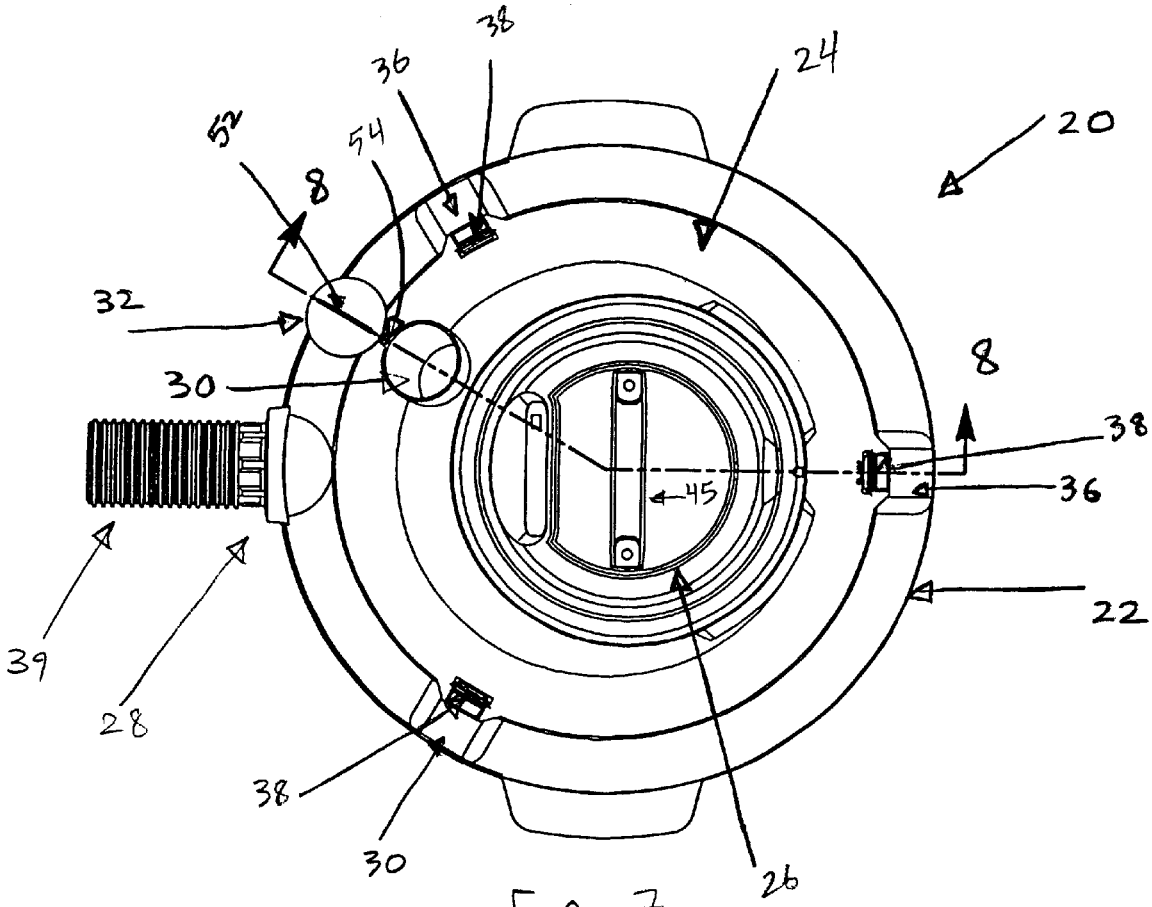
FIG. 7 is a top elevational view of the vacuum cleaner of FIG. 5 having the debris opening in an open position.
Figure 8:
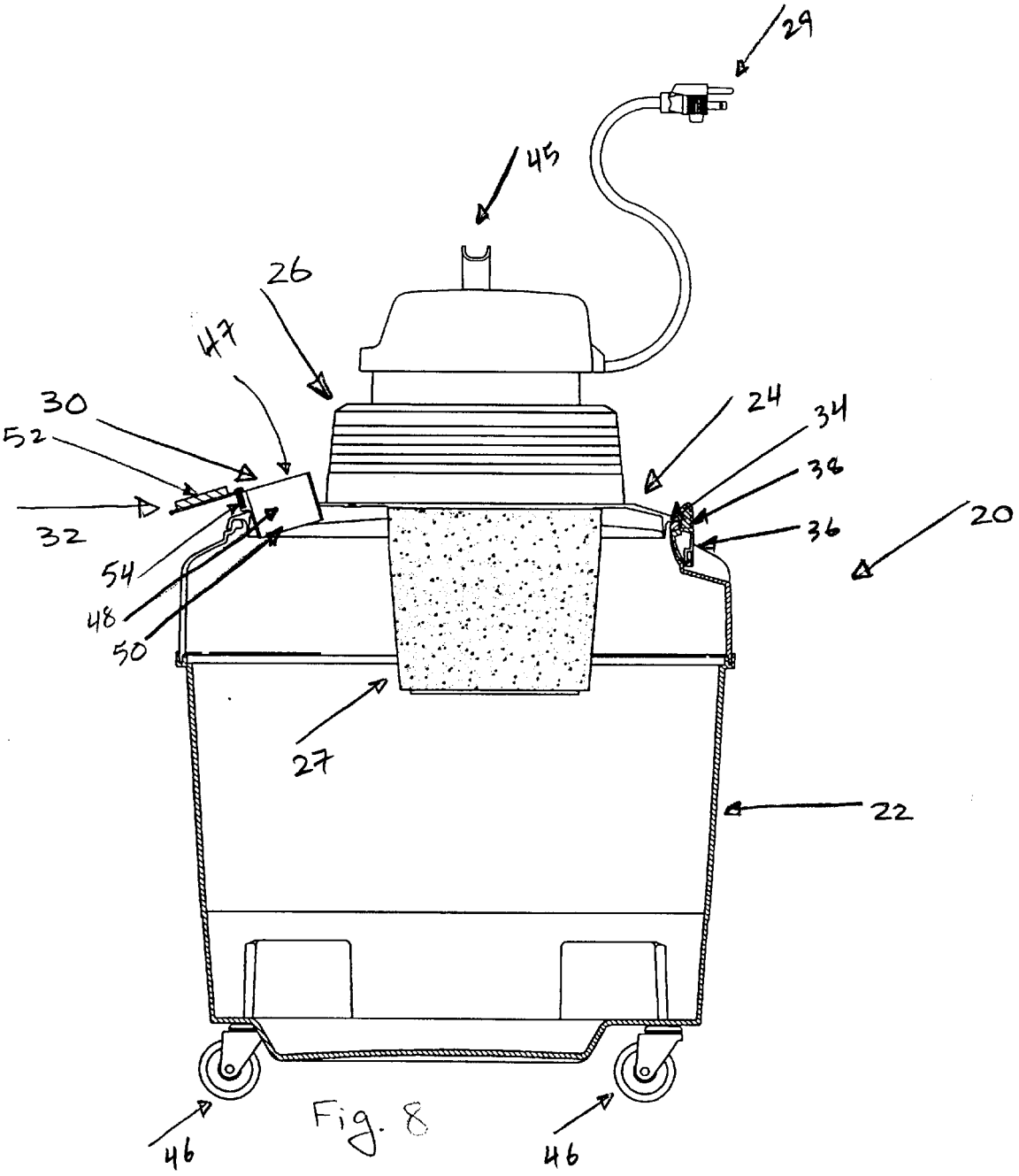
FIG. 8 is a partial cross-sectional view of the vacuum cleaner of FIG. 7 taken at the lines 8—8 of FIG. 7.
Figure 9:
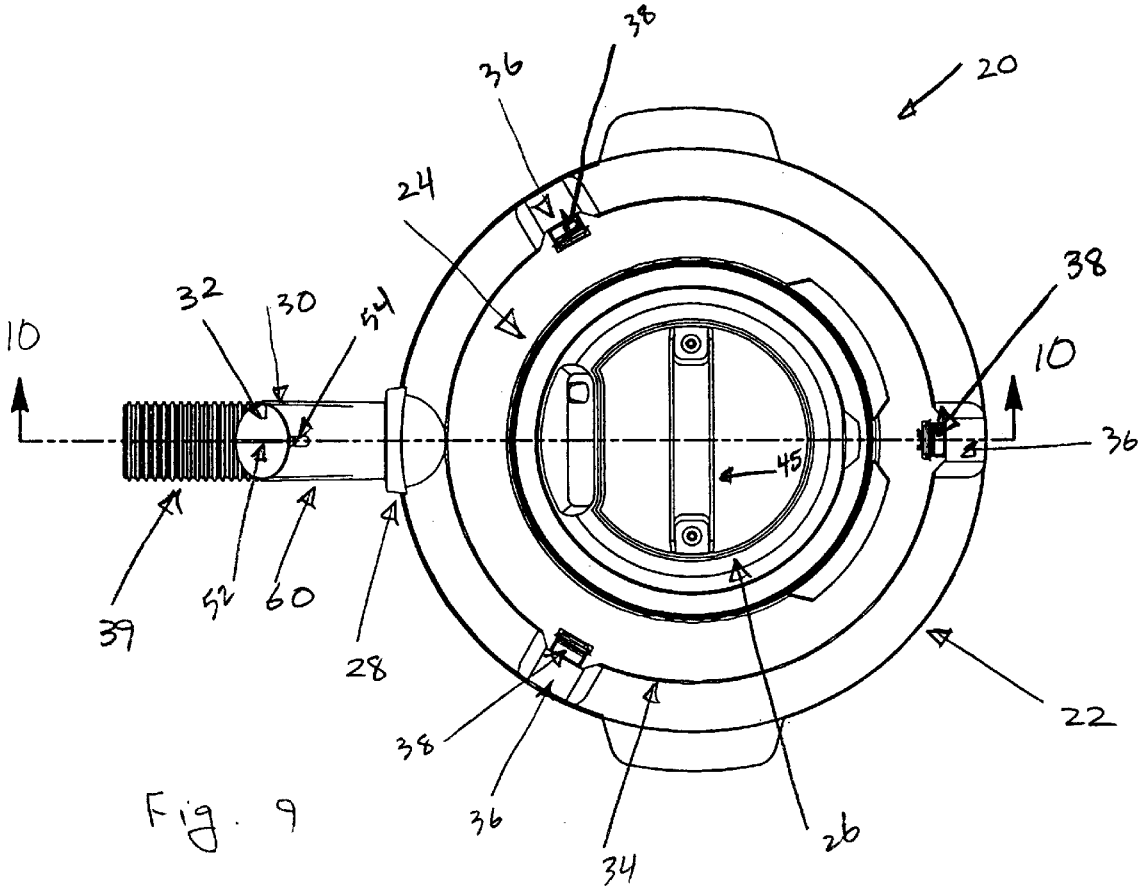
FIG. 9 is a top elevational view of a third embodiment of a vacuum cleaner of the present invention having an adaptor attached to a hose having a debris opening on the adaptor and a door on the debris opening in a closed position.
Figure 10:
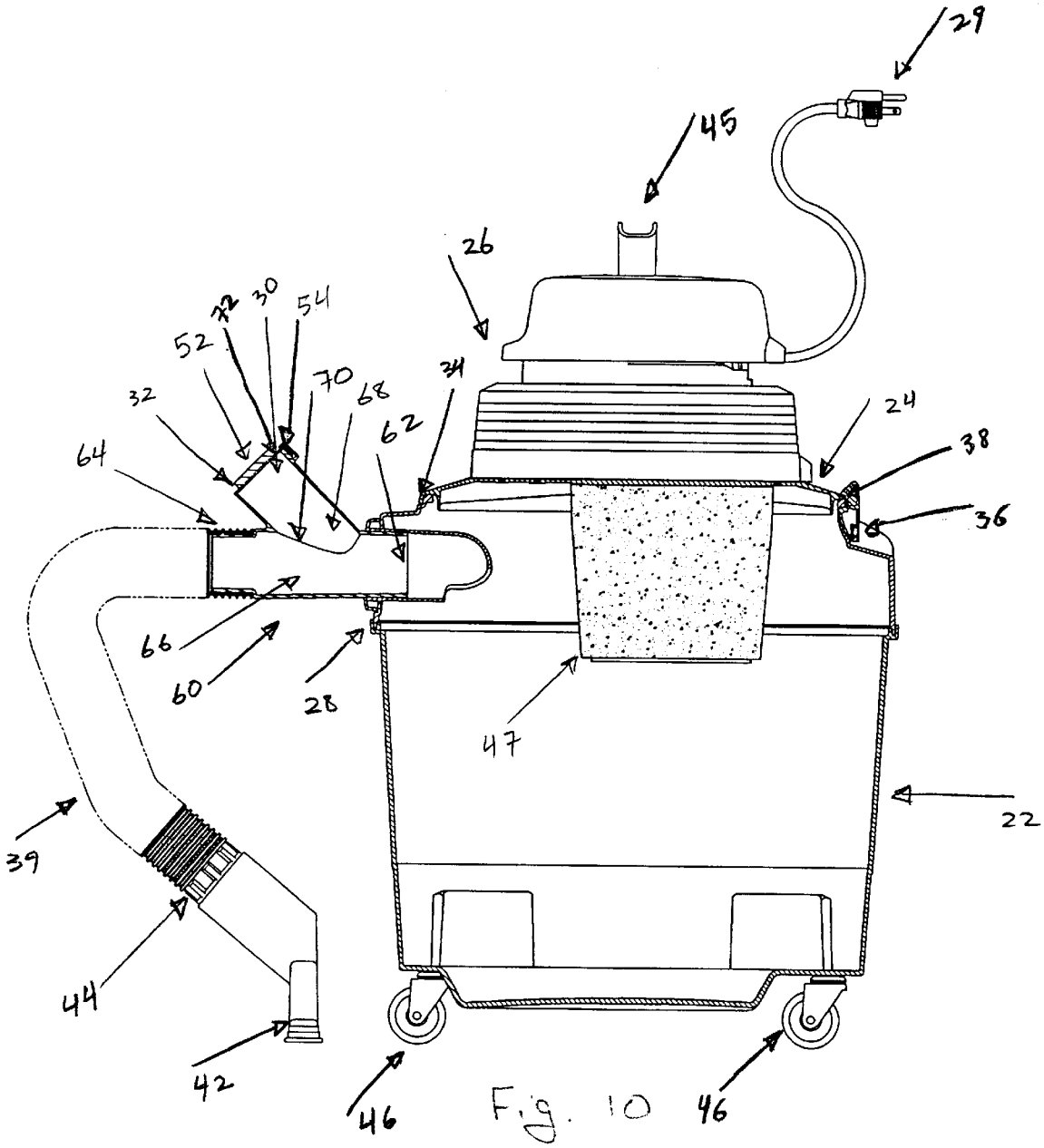
FIG. 10 is a partial cross-sectional view of the vacuum cleaner of FIG. 9 taken at lines 10—10 of FIG. 9.
Figure 11:
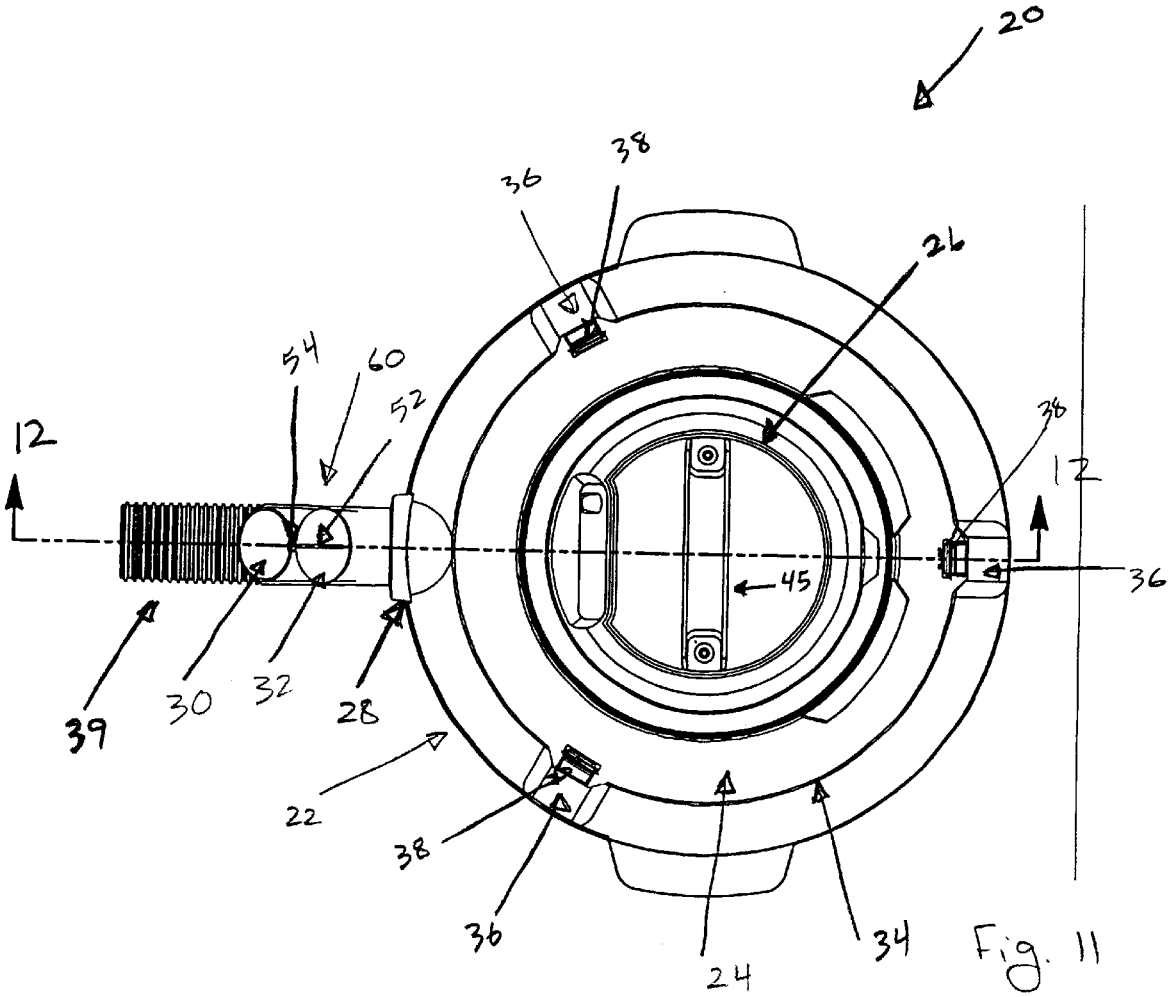
FIG. 11 is a top elevational view of the vacuum cleaner of FIG. 9 with the door on the debris opening in an open position.
Figure 12:
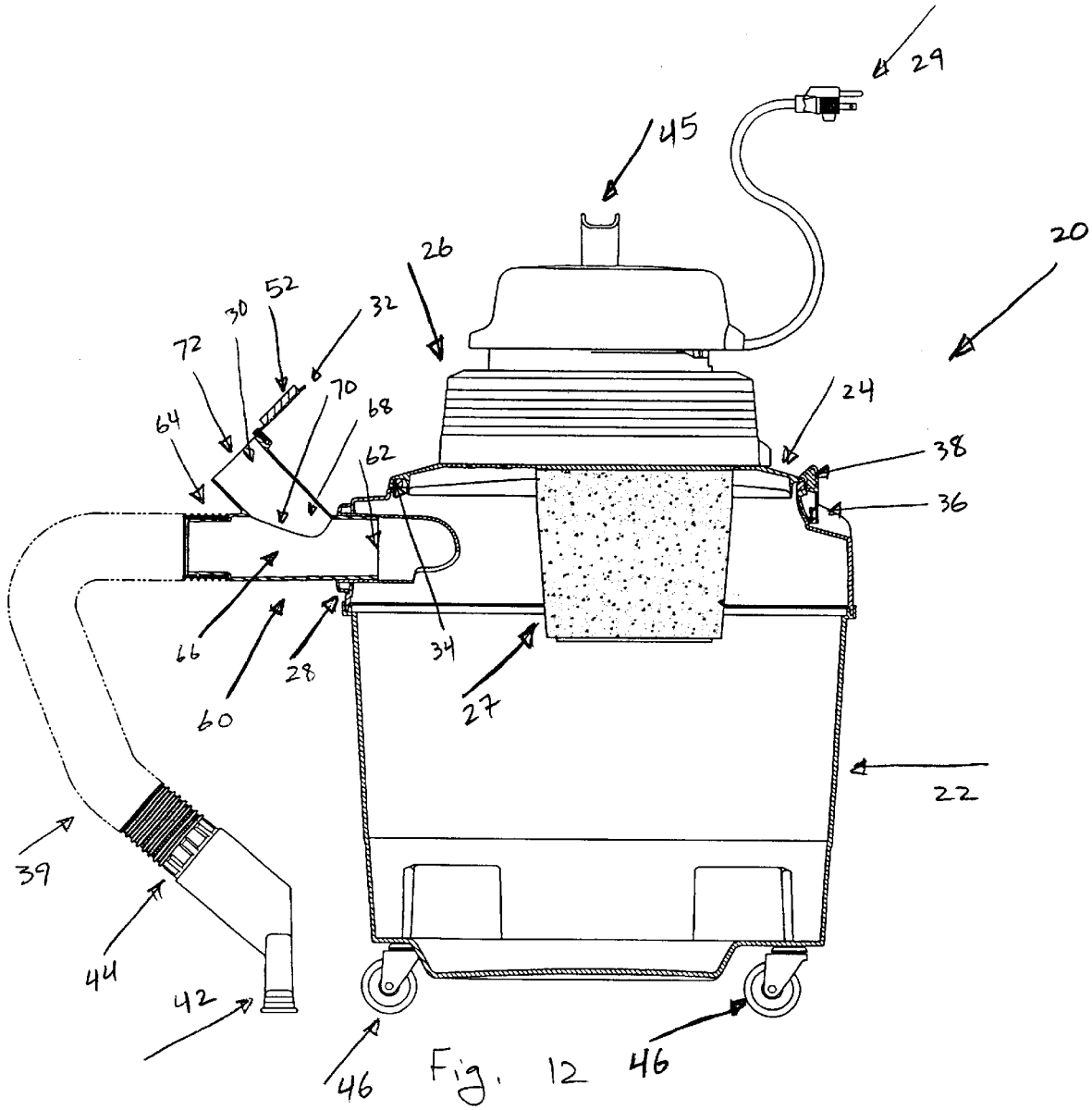
FIG. 12 is a partial cross-sectional view of the vacuum cleaner of FIG. 11 taken at lines 12—12 of FIG. 11.
Figure 13:
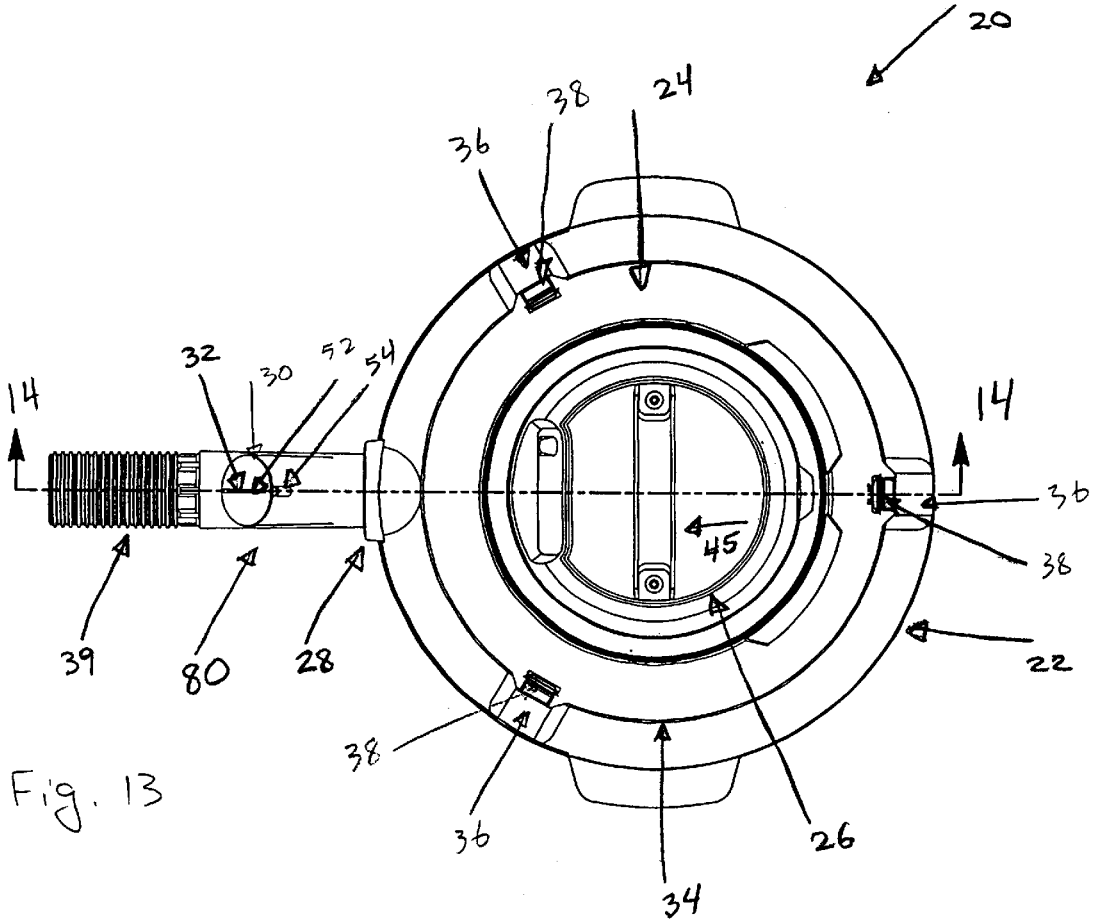
FIG. 13 is a top elevational view of a fourth embodiment of a vacuum cleaner of the present invention having an adaptor removably connected to a hose having a debris opening on the adaptor and a door on the debris opening in a closed position.
Figure 14:
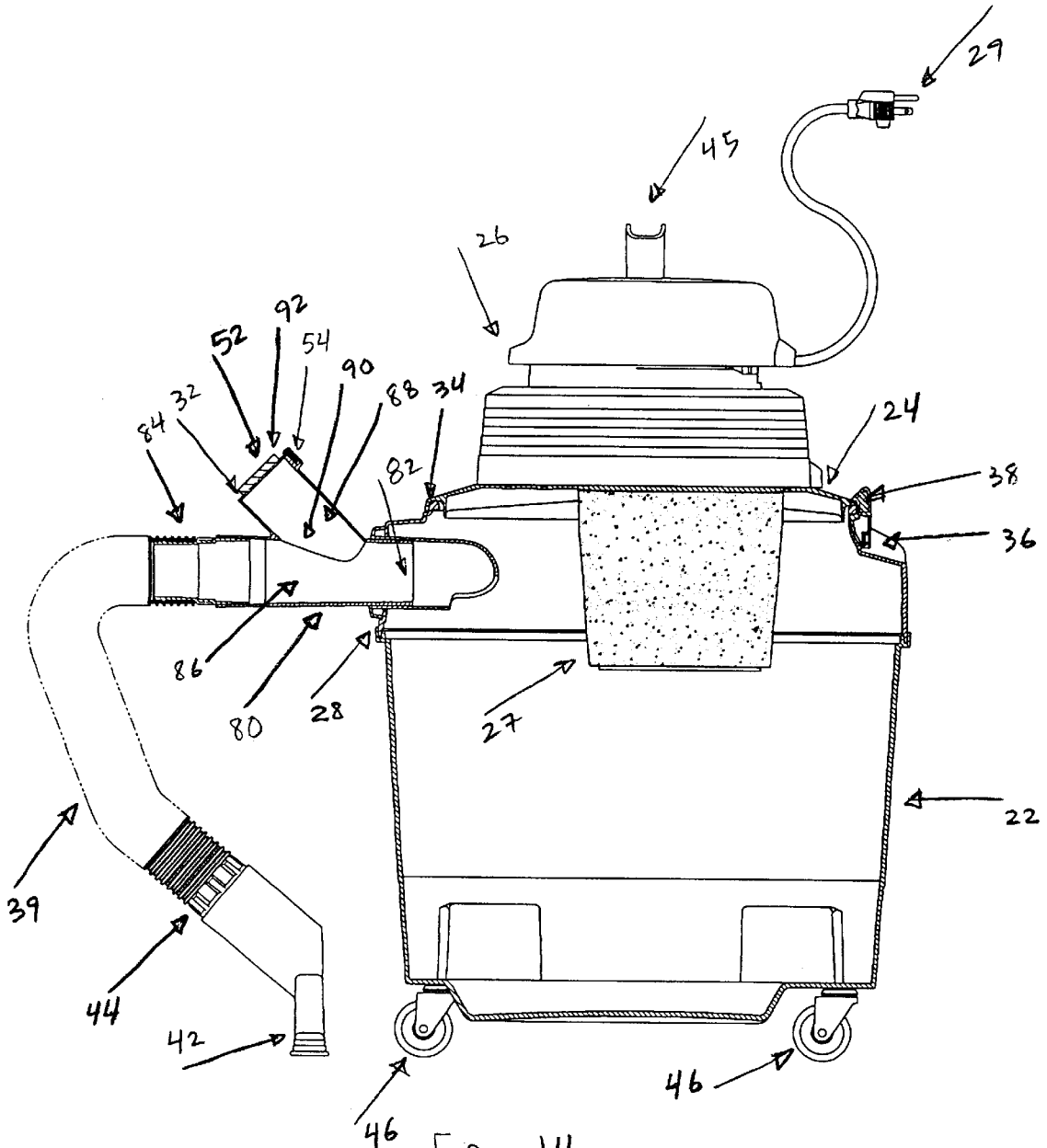
FIG. 14 is a partial cross-sectional view of the vacuum cleaner of FIG. 13 taken at lines 14—14 of FIG. 13.
Figure 15:
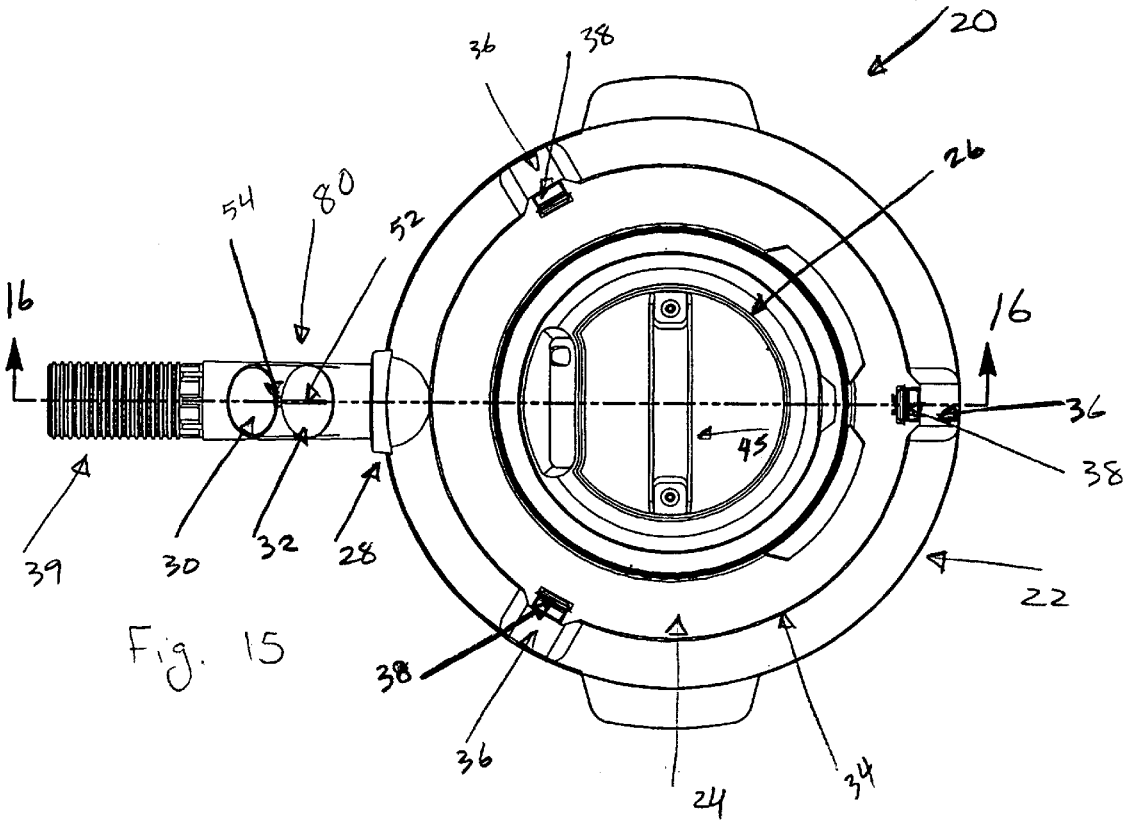
FIG. 15 is a top elevational view of the vacuum cleaner of FIG. 13 with the door on the debris opening in an open position.
Figure 16:
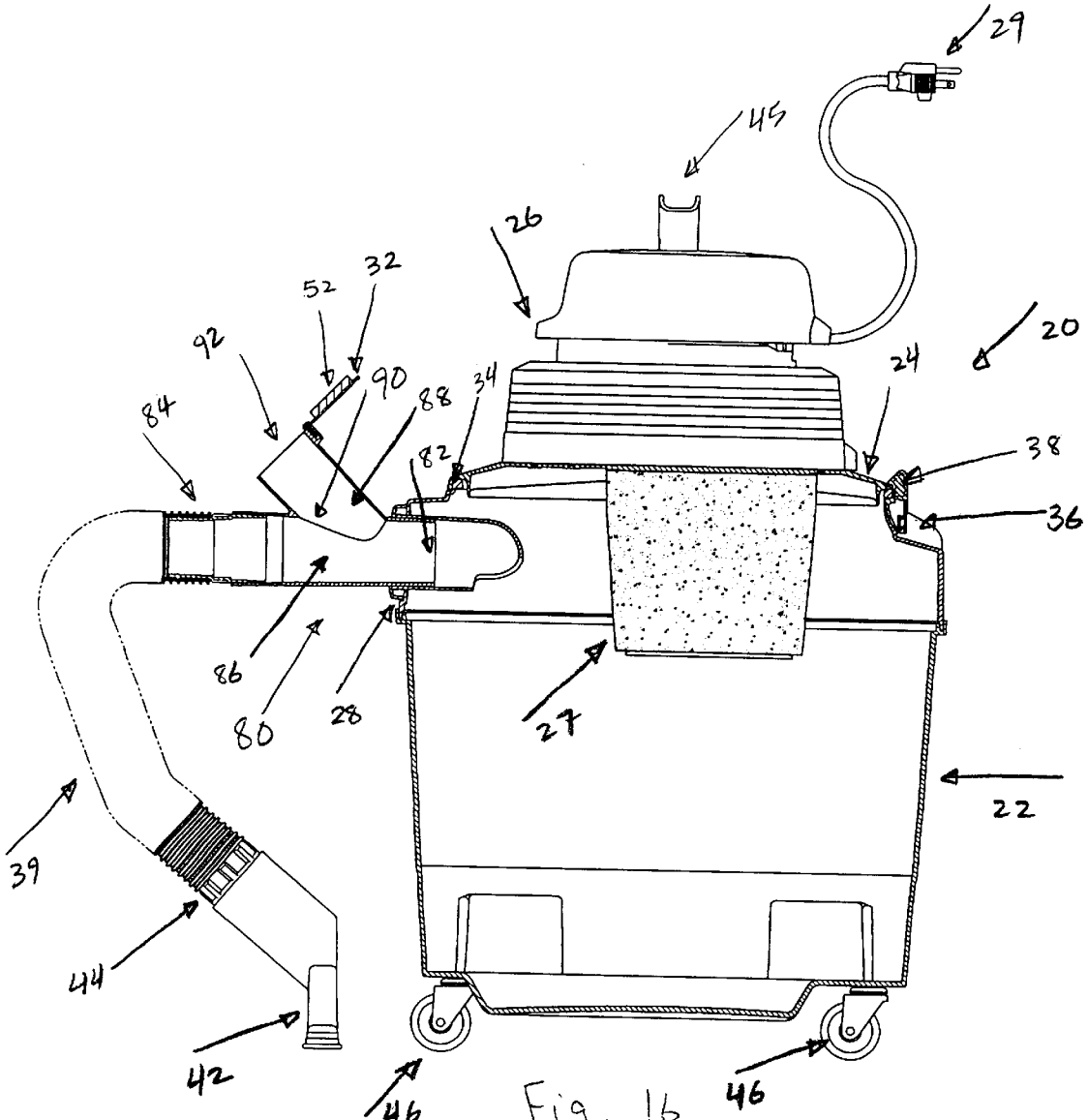
FIG. 16 is a partial cross-sectional view of the vacuum cleaner of FIG. 15 taken at lines 16—16 of FIG. 15.

When the vacuum cleaner 20 is in operation, the low pressure created in the receptacle 22 by the motor assembly 26 creates a pressure difference between the receptacle 22 and the nozzle 42 to cause a suction effect at the nozzle 42. Small debris enters the nozzle 42, travels through the hose 39, and is deposited into the receptacle 22. The debris opening 30 accommodates large debris that cannot enter or that may become trapped inside of the hose 39. The door 32, having a tab 52, rotates about a hinge 54 to open and close the debris opening 30. As seen in FIGS. 2 and 4, the debris opening 30 has a first end 47 of a pipe section 48 with a second end 50 opening into the receptacle 22. A vacuum cleaner operator manually picks up large debris, opens the door 32, drops the debris in the receptacle 22 through the debris opening 30, and closes the door 32. Although a door set on a rotating hinge is preferred, numerous other types of doors, including removable doors with various closures, and doors with other types of hinges can be used to open and close the debris opening 30. The door may also be spring loaded so that in order to open the door, the force of the spring must be overcome, for instance, by pushing or pulling the door to provide access for the debris.

Described below are other embodiments of the present invention in which certain elements in those other embodiments are identical to elements in the first embodiment. Where elements are identical, they have been given the same numbers throughout the embodiments.

In a second embodiment of the present invention, as illustrated in FIGS. 5–8, the debris opening 30 is in the lid 24 instead of in the receptacle 22 as shown in FIGS. 1–4. The debris opening 30 has a first end 47 (shown in FIGS. 6 and 8) of a pipe section 48 (shown in FIGS. 6 and 8) with a second end 50 (shown in FIGS. 6 and 8) having air flow communication within the inside receptacle 22. The door 32 rotates about the hinge 54 to open and close the debris opening 30. A vacuum cleaner operator can manually pick up large debris, open the door 32, drop the debris inside the receptacle 22 through the debris opening 30, and close the door 32.

In a third embodiment of the present invention, as illustrated in FIGS. 9–12, an adaptor 60 is removably connected to the hose inlet 28 at a first end 62 (shown in FIGS. 10 and 12) of the adaptor 60 and attached to the hose 39 at a second end 64 (shown in FIGS. 10 and 12) of the adaptor 60. Since the adaptor 60 is attached to the hose 39, it can be considered a part of the hose 39, where the first part of the hose is rigid and the second part of the hose is flexible. The adaptor 60 comprises a primary pipe 66 (shown in FIGS. 10 and 12) and a secondary pipe 68 (shown in FIGS. 10 and 12). The secondary pipe 68 is attached at a first end 70 (shown in FIGS. 10 and 12) to the primary pipe 66 and is in air flow communication with the primary pipe 66. A second end 72 (shown in FIGS. 10 and 12) of the secondary pipe 68 is the debris opening 30. The door 32 rotates about the hinge 54 to open and close the debris opening 30. The first end 62 of the adaptor 60 mates with the hose inlet 28 to form a friction fit, similar to the fit that a hose and hose inlet usually have on a vacuum cleaner. The adaptor 60 can be removed from the vacuum cleaner 20 by pulling the first end 62 of the adaptor 60 out of the hose inlet 28. In use, a vacuum cleaner operator can manually pick up large debris, open the door 32, drop the debris inside debris opening 30, and close the door 32. The debris will be pulled into the receptacle 22 by the suction created by the vacuum cleaner. In order to minimize clogging of the hose 39, it is advantageous to have the debris opening 32 located adjacent the hose inlet 28.

In a fourth embodiment of the present invention, as illustrated in FIGS. 13–16, an adaptor 80 is removably connected to the hose inlet 28 at the first end 82 (shown in FIGS. 14 and 16) of the adaptor 80 and removably connected to the hose 39 at the second end 84 (shown in FIGS. 14 and 16) of the adaptor. The adaptor 80 comprises a primary pipe 86 (shown in FIGS. 14 and 16) and a secondary pipe 88 (shown in FIGS. 14 and 16). The secondary pipe 88 is attached at a first end 90 (shown in FIGS. 14 and 16) to the primary pipe 86 and is in air flow communication with the primary pipe 86. A second end 92 (shown in FIGS. 14 and 16) of the secondary pipe 88 is the debris opening 30. The door 32 having a tab 52 rotates about the hinge 54 to open and close the debris opening 30. The first end 82 of the adaptor 80 mates with the hose inlet 28 to form a friction fit. The first end 40 of the hose 39 mates with the second end 84 of the adaptor to form a friction fit. The friction fit at the two ends of the adaptor 80 is similar to the fit that a hose and hose inlet usually have on a vacuum cleaner. The adaptor 80 can be removed from the vacuum cleaner 20 by pulling the first end 82 of the adaptor 80 out of the hose inlet 28. The adaptor 80 can be removed from the hose 39 by pulling the hose 39 out of the second end 84 of the adaptor 80. As with other embodiments, a vacuum cleaner operator can manually pick up large debris, open the door 32, drop the debris into the debris opening 30, and close the door 32.

The adaptor 80 of FIGS. 13–16 can be sold with a vacuum cleaner or can be sold separately for use with existing vacuum cleaners. If sold separately, the ends of the adaptor 80 should be designed to mate with the hose and hose inlet of existing vacuum cleaners.

Although a tank-type vacuum cleaner has been shown in FIGS. 1–16, other types of vacuum cleaners, such as upright vacuum cleaners, back pack vacuum cleaners, etc., may be used in connection with the present invention. In such a situation, the debris opening of the present invention would be placed on such a vacuum cleaner or an adaptor, so that large debris can be placed in the receptacle of the vacuum cleaner, either directly or indirectly.

The foregoing detailed description has been given for clearness of understanding only, and no unnecessary limitations should be understood therefrom, as modifications would be obvious to those skilled in the art.

What is claimed is:

1. A method for placing large debris in a vacuum cleaner, the vacuum cleaner having an air inlet, a receptacle with a removable lid, and a motor assembly mounted on the lid and arranged to draw air from the receptacle, the method comprising the steps of:

(a) providing a debris opening in the receptacle;

(b) providing a door adjacent the debris opening, the door moveable between a first position closing the debris opening and a second position in which the debris opening is not closed;

(c) moving the door from the first position to the second position to open the debris opening;

(d) depositing debris in the debris opening; and (e) moving the door from the second position to the first position to close the debris opening.

2. The method of claim 1, including the additional steps of: providing a hinge on the door, and rotating the door between the first and second positions.

3. A method for placing large debris in a vacuum cleaner, the vacuum cleaner having an air inlet, a receptacle with a removable lid, and a motor assembly mounted on the lid and arranged to draw air from the receptacle, the method comprising the steps of:

(a) providing a debris opening in the lid;

(b) providing a door adjacent the debris opening, the door moveable between a first position closing the debris opening and a second position in which the debris opening is not closed;

(c) moving the door from the first position to the second position to open the debris opening;

(d) depositing debris in the debris opening; and (e) moving the door from the second position to the first position to close the debris opening.

4. The method of claim 3, including the additional steps of: providing a hinge on the door, and rotating the door between the first and second positions.

5. A method for placing large debris in a vacuum cleaner, the vacuum cleaner having an air inlet, a receptacle with a removable lid, a motor assembly mounted on the lid and arranged to draw air from the receptacle, and a hose inlet on the receptacle, the hose inlet adapted to receive a hose, the method comprising the steps of:

(a) placing an adaptor in the hose inlet, the adaptor comprising:

a first end having a first opening, the first end sized to engage the hose inlet;

a second end having a second opening, the second end adapted to receive the hose;

a debris opening; and a door, the door moveable between a first position closing the debris opening and a second position in which the debris opening is not closed;

(b) moving the door from the first position to the second position to open the debris opening;

(c) depositing debris in the debris opening; and (d) moving the door from the second position to the first position to close the debris opening.

6. The method of claim 5, including the additional steps of: providing a hinge on the door, and rotating the door between the first and second positions.

7. The method of claim 5, wherein the adaptor further comprises a conduit having a first pipe and a second pipe, the first pipe and the second pipe converging toward the first end.

8. The method of claim 7, wherein at least one of the first and second pipes terminates at the debris opening.

9. The method of claim 7, wherein the conduit is Y-shaped.

* * * * *